US007380372B2

(12) United States Patent
Resch et al.

(10) Patent No.: US 7,380,372 B2
(45) Date of Patent: Jun. 3, 2008

(54) WALL BRACING SYSTEM AND METHOD OF SUPPORTING A WALL

(75) Inventors: Gary C. Resch, St. Cloud, MN (US); Greg T. Resch, St. Cloud, MN (US)

(73) Assignee: Resch Enterprises, Inc., St. Cloud, MN (US)

( * ) Notice: Subject to any disclaimer, the term of this patent is extended or adjusted under 35 U.S.C. 154(b) by 634 days.

(21) Appl. No.: 11/107,158

(22) Filed: Apr. 15, 2005

(65) Prior Publication Data

US 2006/0080926 A1 Apr. 20, 2006

Related U.S. Application Data

(60) Provisional application No. 60/620,635, filed on Oct. 19, 2004.

(51) Int. Cl.
*E04G 21/04* (2006.01)
*E04G 21/26* (2006.01)

(52) U.S. Cl. ..... 52/127.2; 52/126.3; 52/150; 52/151; 248/201

(58) Field of Classification Search ..... 52/127.2, 52/DIG. 11, 126.1, 126.3, 126.4, 150–151, 52/125.6, 514; 248/201, 300, 218; 405/285
See application file for complete search history.

(56) References Cited

U.S. PATENT DOCUMENTS

| | | | | |
|---|---|---|---|---|
| 2,914,147 | A | 11/1959 | Millard | |
| 3,030,061 | A | 4/1962 | Jennings | |
| 3,095,666 | A | 7/1963 | Killen | |
| 3,817,006 | A | 6/1974 | Williams | |
| 4,048,771 | A * | 9/1977 | Thistlethwaite | 52/127.2 |
| 4,068,427 | A | 1/1978 | Camardo | |
| 4,083,156 | A | 4/1978 | Tye | |
| 4,268,066 | A | 5/1981 | Davis | |
| 4,304,078 | A | 12/1981 | Meriwether, Jr. | |
| 4,872,634 | A | 10/1989 | Gillaspy et al. | |
| 4,937,989 | A | 7/1990 | Miyares et al. | |
| 5,913,787 | A | 6/1999 | Edwards | |
| 5,956,906 | A | 9/1999 | Berich et al. | |
| 6,073,405 | A | 6/2000 | Kasai et al. | |
| 6,112,475 | A | 9/2000 | Truitt | |
| 6,141,932 | A | 11/2000 | Tarrant | |
| 6,173,809 | B1 * | 1/2001 | Cole et al. | 182/3 |
| 6,256,940 | B1 * | 7/2001 | MacKarvich | 52/126.6 |
| 6,662,505 | B2 | 12/2003 | Heady et al. | |

* cited by examiner

*Primary Examiner*—Richard E. Chilcot, Jr.
*Assistant Examiner*—Chi Q. Nguyen
(74) *Attorney, Agent, or Firm*—North Oaks Patent Agency; Shawn B Dempster

(57) ABSTRACT

In accordance with one preferred embodiment of the present invention, a wall brace apparatus for use in supporting a damaged wall from the interior of a building basement is disclosed. The wall brace apparatus includes an alignment brace positioned between a floor bracket, which is secured to a floor and a pushing rod bracket, which is secured to an overhead floor joist and aligned with the floor bracket. The wall brace is further attached to brace holders which are secured between the pushing rod bracket and the wall surface. The wall brace apparatus includes a jack mechanism positioned between the pushing rod bracket and the alignment brace with holding brackets positioned between the pushing rod bracket and the overhead floor joists. A method of supporting a wall from the interior of a building basement having overhead floor joists is also disclosed.

24 Claims, 4 Drawing Sheets

WALL BRACING SYSTEM AND METHOD OF SUPPORTING A WALL

CROSS REFERENCE TO RELATED APPLICATIONS

This application claims the benefit of U.S. Provisional Patent Application No. 60/620,635, filed Oct. 19, 2004.

FIELD OF THE INVENTION

The present invention generally relates to wall bracing systems. In particular, this application relates to a method and apparatus for bracing a wall that has begun to buckle inward as a result of hydrostatic pressure or other external forces.

BACKGROUND OF THE INVENTION

Various wall bracing systems are known for securing and straightening cracked or bowed basement walls in residential applications. Prior art systems generally include those which utilize soil anchored mechanisms which pull the shifted wall from the exterior of the structure and conventional systems which are used to push the shifted wall from the interior surface. Exterior systems are generally anchored separately from the structure containing the damaged wall, require excavation and tend to be unreliable under varied soil conditions. Interior systems address this need by providing an applied straightening force that is anchored from the structure containing the damaged wall and reduces the need for exterior excavation. As interior systems develop, further improvements may be realized in practice.

As is known in the art, prior art systems utilized in interior applications tend to secure a brace against a fractured or shifting wall, anchoring the bottom portion of a brace to the floor, anchoring the top portion of the brace to an overhead floor joist and utilizing a jack mechanism to adjustably apply force to the brace. Although such systems may prevent further shifting or perhaps straighten the damage to the wall, most of them are designed with a jack mechanism providing only a limited range of adjustment, lack the structural means necessary to apply increased force to straighten a bowed wall in commercial applications and are configurable for limited interior construction configurations. Other mechanisms are designed only for vertical floor joint applications.

Generally accepted in the art is a means to attach holding brackets to one side of overhead floor joists that are oriented perpendicular to the wall surface. Such systems further comprise a jack mechanism to hold the top of the brace vertical along side the floor joist and adjustably apply pressure to the brace which is transferred to the surface of the wall. The bottom portion of the brace in such designs are generally secured to the floor. These designs have a limited range of applied force due to the holding brackets being secured to one side of a single overhead floor joist such that increased force causes floor joists to twist. Such designs further require longer braces which will have a limited range of motion of the jack mechanism and are more likely to deflect than shorter braces. As is known in the art, common configurations of jack mechanisms include a screw jack, lever jack, etc. Additionally, increased force requires further improvements to prevent shifting of the brace from a vertical position and a different approach in order to set the brace at a greater angle of incidence from the wall surface.

Other prior art designs include a bracing configuration with a jack mechanism that fits floor joists running parallel to the surface of the wall. In such designs, a threaded rod pierces the mounting floor joist closest to the holding bracket and further utilizes floor joist supports to distribute the pressure. In such designs, a threaded nut is placed against the floor joist holding bracket and is not able to hold the pushing rod straight which causes some difficulty in lining up the alignment brace properly while holding it straight. This configuration is designed to secure the wall fracture and not intended for subsequent adjustment nor designed to force the shifted wall back into a vertical position. This approach fails to address other overhead construction configurations such as cases where duct work resides between the floor joists, thereby preventing the ability to utilize the space between the floor joists. Therefore, such designs lack the range of motion needed for subsequent adjustments to the brace position, lack the applied force necessary to return a shifted wall back into position and fail to address further overhead bracing configuration needs.

There is therefore an unmet need to increase perpendicularly applied force for interior applications of straightening and supporting damaged walls in a wide range of motion, under overhead floors of different configurations.

SUMMARY OF THE INVENTION

The present invention relates to wall bracing systems that mount between overhead floor joists and a floor, providing sufficient force to straighten a damaged wall and configurable for application in a variety of overhead floor joist orientations which solve the above-mentioned problem.

In accordance with one preferred embodiment of the present invention, a wall brace apparatus for use in supporting a damaged wall from the interior of a building basement is disclosed. The wall brace apparatus includes an alignment brace positioned between a floor bracket, which is secured to a floor and a pushing rod bracket, which is secured to an overhead floor joist and aligned with the floor bracket. The wall brace is further attached to brace holders which are secured between the pushing rod bracket and the wall surface. The wall brace apparatus includes a jack mechanism positioned between the pushing rod bracket and the alignment brace with holding brackets positioned between the pushing rod bracket and the overhead floor joists. A method of supporting a wall from the interior of a building basement having overhead floor joists is also disclosed.

Additional advantages and features of the invention will be set forth in part in the description which follows, and in part, will become apparent to those skilled in the art upon examination of the following or may be learned by practice of the invention.

DETAILED DESCRIPTION

Numerous wall bracing systems exist, however the current systems available fail to meet the more advanced needs of the market to provide increased force to straighten a damaged wall and to be applicable to various configurations of overhead floor joists. The present invention will be described in preferred embodiments and is not intended to be limited as described. It is intended that the present invention cover all modifications and alternatives within the scope and spirit of the invention.

Figure 1:
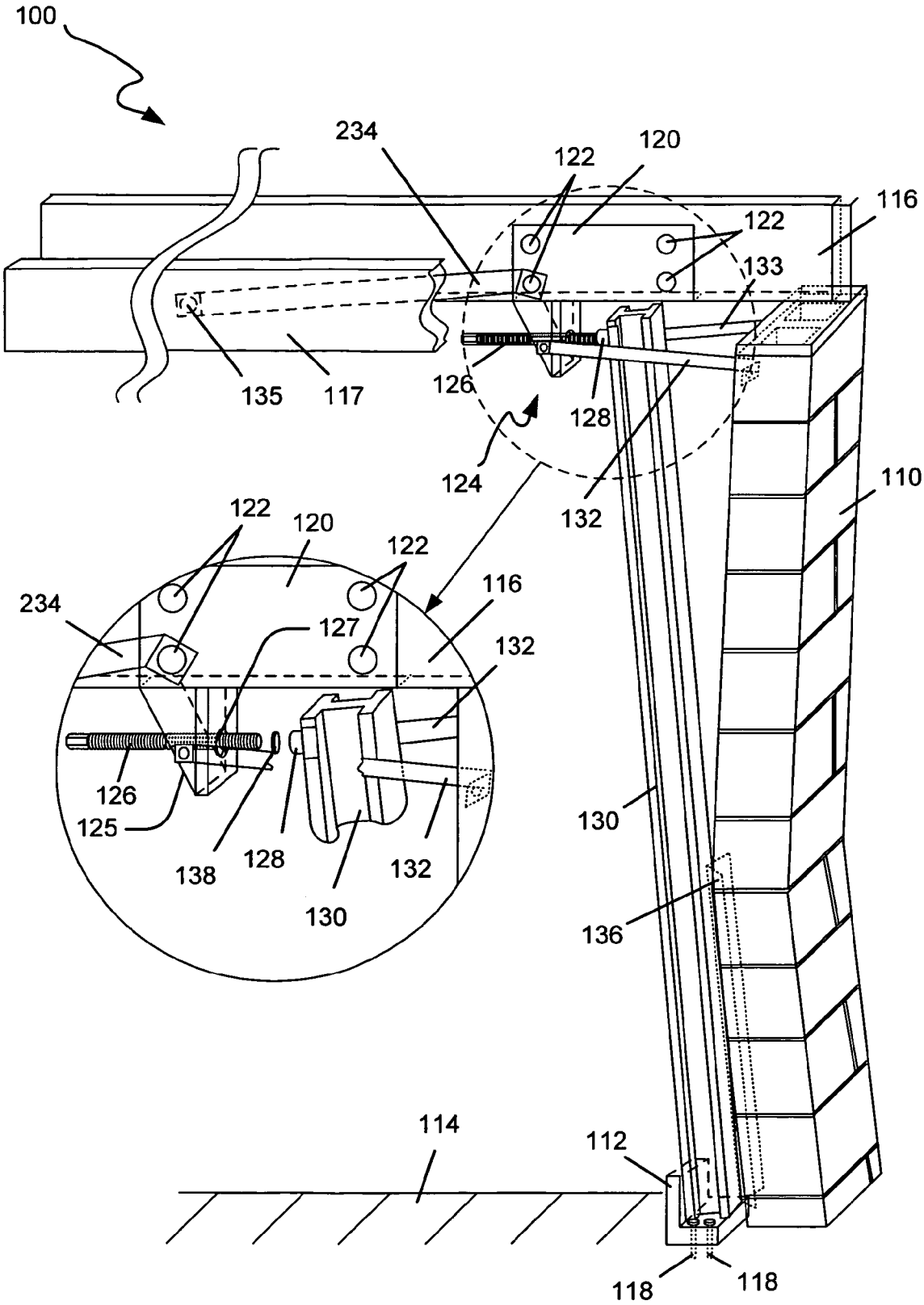
FIG. 1 is a perspective view of one preferred embodiment of the wall brace system as installed with overhead floor joists running perpendicular to the damaged wall.
Figure 2:
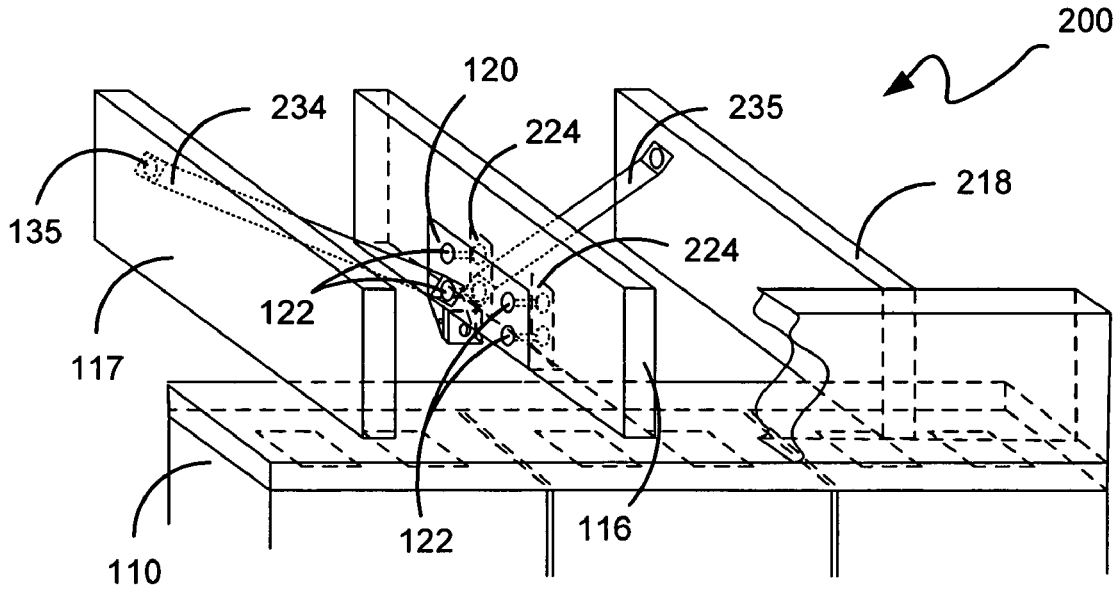
FIG. 2 is a perspective view of the pushing rod bracket of FIG. 1 as installed with holding brackets.

FIG. 1 illustrates one embodiment of the present invention. The wall bracing system 100 is used for both supporting and straightening a damaged wall 110. The damaged wall 110 may be of a variety of materials which are common in building construction such as cinder block, concrete, etc. A floor bracket 112 is secured to a floor 114 adjacent to the damaged wall 110 using appropriate fasteners 118. In one preferred embodiment, the floor bracket 122 is preferably made of heavy gauge steel and the fasteners 118 are made of steel concrete anchors, although other materials having similar strength and stress capabilities may be utilized. Although it is common practice to secure the floor bracket 112 with only two fasteners 118, three or more fasteners 118 may be used instead to increase holding capability and address softened or thin floor surfaces. In one preferred embodiment, the floor is made of concrete but other materials may be utilized. A pushing rod bracket 120 is secured to an overhead floor joist 116 with appropriate fasteners 122. It is common in the art that overhead floor joists 116 may be constructed of wood beams, wood trusses, steel or fiber-reinforced composite products. Although the fasteners 122 may comprise bolts with washers and nuts, in one preferred embodiment, the washers are replaced with backer plates 224, which are further illustrated in FIG. 2. An alignment brace 130, having in upper and lower portion, is positioned with its lower portion resting upon the floor bracket 112. A pushing rod idler 128 is attached to the upper portion of the alignment brace 130. The pushing rod idler 128 includes a substantially round riser on a side opposite the alignment brace 130 containing a magnetic insert 138. The magnetic insert 138 is used to hold the pushing rod idler 128 onto the threaded rod 126 and also lubricates the end of the threaded rod 126 as abrasion releases particles from the magnetic insert 138. A jack mechanism 124 consists of a threaded rod 126 passing through a threaded hole 127 in a flange 125 at the base of the pushing rod bracket 120. This threaded flange 127 holds the threaded rod 126 straight while it is being installed. The threaded rod 126 is seated into the riser on the pushing rod idler 128. The threaded rod 126 is adjusted to apply pressure to the pushing rod idler 128, thereby forcing the alignment brace 130 against the damaged wall 110. Brace holders 132 and 133 are secured between the pushing rod bracket 120 and the damaged wall 110, which serve to maintain a vertical position of the alignment brace 130. Although the brace holders 132 and 133 are shown in the figure as secured to the damaged wall 110, alternatively they may be tied together with plastic tie fasteners during installation. At least one tube bracket holder 234 is secured between the pushing rod bracket 120 and an overhead floor joist 117 with fastener 122 at the pushing rod bracket 120 end and fastener 135 at the overhead floor joist 117 end. Additional tube bracket holders 235 may be desired for increased applied force needed to straighten a damaged wall 110, as is illustrated in FIG. 2. In such cases additional tube bracket holder 235 maybe installed on another overhead floor joist 118 adjacent to the location of the pushing rod bracket 120. In the event that the damaged wall 110 is softening or deteriorated at the bracing surface, a wall plate 136 may be utilized to further distribute the applied force from the alignment brace 130, thereby preventing further surface damage to the damaged wall 110. In one preferred embodiment, the wall plate 136 is approximately ten to twelve inches wide, three to four feet tall, and one eighth to three sixteenth inches thick, although smaller or larger wall plates can be used. It is known in the art that wall construction may include cinder blocks, concrete, bricks, clay tile, etc. with varying degrees of hardness in addition to the exact vertical position of the fracture, therefore the size of the wall plate 136 may be changed accordingly, such that softer walls will require a wall plate 136 with greater surface area and can extend from the fracture to the floor 114.

One embodiment of the bracing system 200 uses reinforcement to increase applied force to the damaged wall 110 as illustrated in FIG. 2. Two tube bracket holders 234 and 235 are attached between the pushing rod bracket 120 and overhead floor joists 117 and 218, respectively, which are adjacent to overhead mounting floor joist 116. This will allow for increased applied force to the damaged wall 110. Alternatively, tube bracket holders 234 and 235 may be replaced by a sheet of plywood or sheet metal, secured to the bottom surface of floor joist 116 and two adjacent floor joists 117 and 218 to provide added force distribution.

Figure 3:
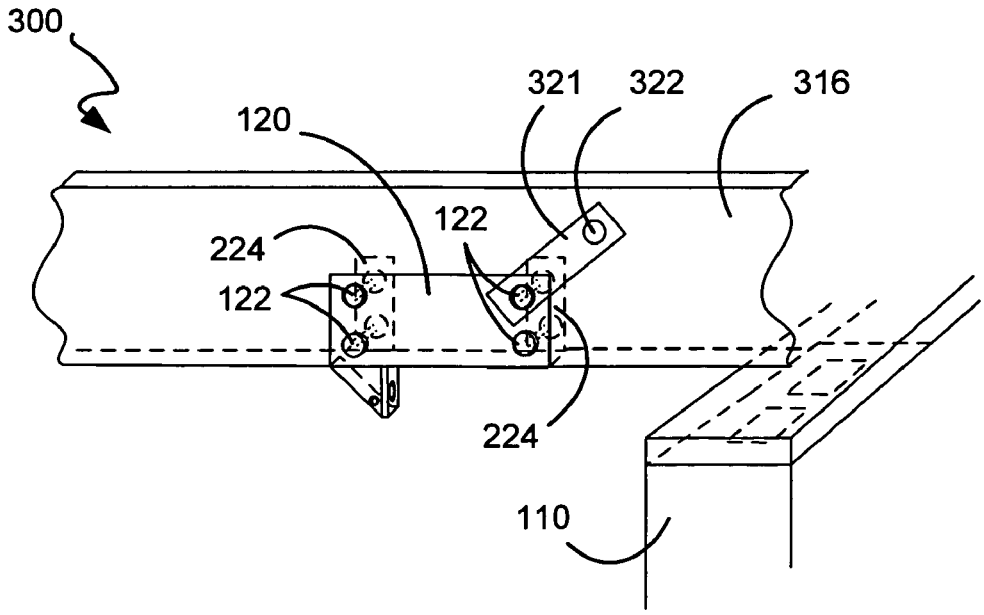
FIG. 3 is a perspective view of the pushing rod bracket of FIG. 1 as installed with the optional backer support plate.

One embodiment of the present invention includes a bracing system 300 as illustrated in FIG. 3, which includes increased support for applications which include softened floor joists such as soft floor joist 316 to support or straighten damaged wall 110. At least one backer support plate 321 is securely fastened with appropriate fasteners 322 to pushing rod bracket 120, positioning the backer support plate 321 at an angle with respect to vertical.

Figure 4:
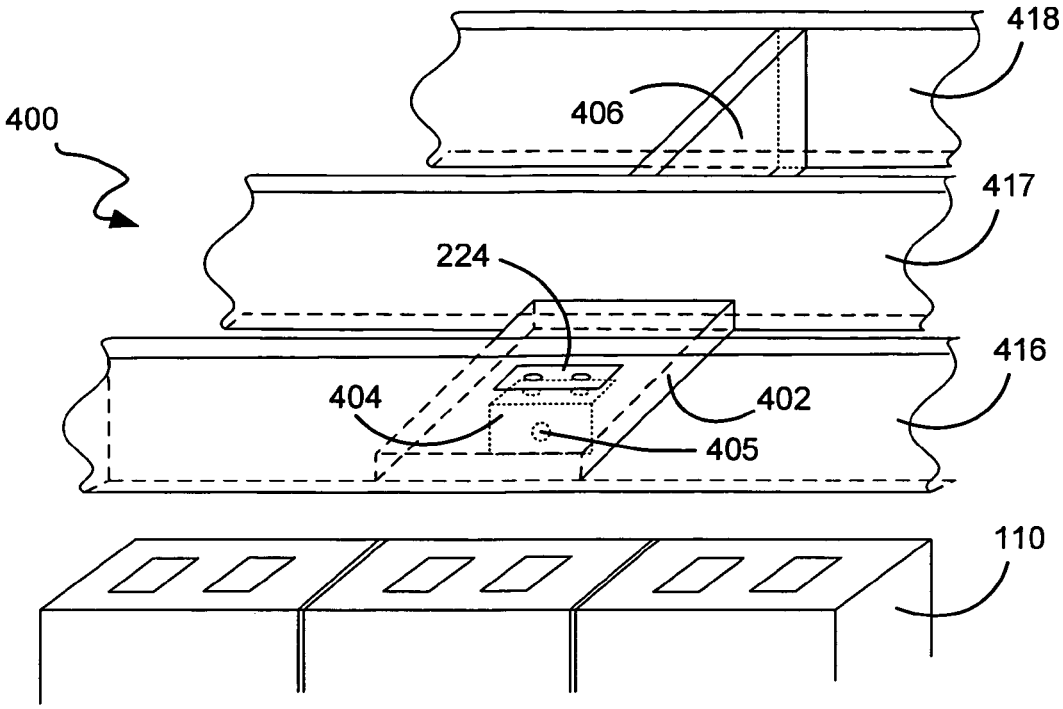
FIG. 4 is a perspective view of one preferred embodiment of the flat pushing rod bracket as applied to overhead floor joists running parallel to the damaged wall.

One embodiment of the present invention includes a bracing system 400 which would be utilized in different overhead mounting configurations as illustrated in FIG. 4. One such embodiment could be utilized to mount the bracing system 400 to floor joists 416-418 that are aligned substantially parallel to the surface of a damaged wall 110. A horizontal blocking plate 402 is mounted between the bottom of floor joists 416 and 417. Flat pushing rod bracket 404 is fastened to the underside of horizontal blocking plate 402 with backer plate 224 on the top surface, aligned with the brace for the damaged wall 110. A flat pushing rod bracket 404 includes welded on nut 405 that accomplishes the same thing as threaded hole 127 in a flange 125 at the base of the pushing rod bracket 120. This welded on nut 405 holds the threaded rod 126 straight while it is being installed. The threaded rod 126 is seated into the riser on the pushing rod idler 128. At least one vertical blocking 406 is attached between overhead floor joists 417 and 418. Additional vertical blocking may be desired on subsequent floor joists as needed to distribute the bracing pressure. Alternatively, tube bracket holders 234 and 235 may be replaced by a sheet of plywood or sheet metal, secured to the bottom surface of floor joist 416 and two adjacent floor joists 417 and 418 to provide added force distribution.

Figure 5:
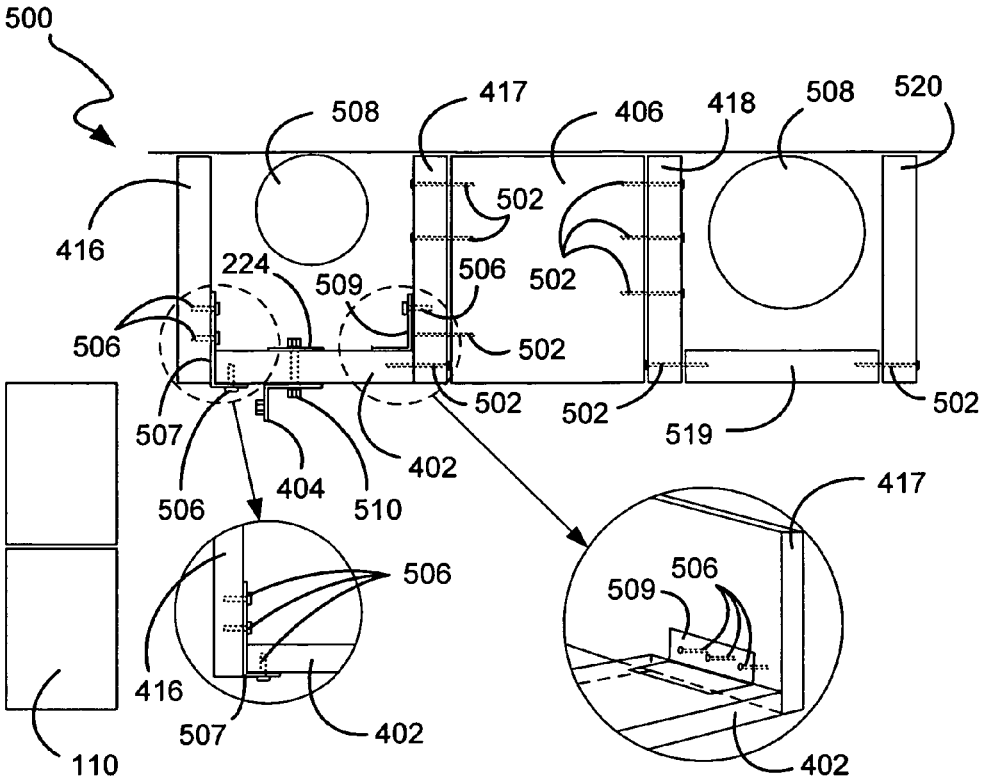
FIG. 5 is a side view of one preferred embodiment showing a variation of the drawing illustrated in FIG. 4, with more detail.

One embodiment of the present invention is illustrated in FIG. 5, which includes a bracing system 500 used to address mounting configurations that would not be addressed by the bracing system of FIG. 1. The bracing system 500 includes a configuration similar to FIG. 4 in that the overhead floor joists 416-418 are aligned substantially parallel to the surface of the damaged wall 110. Additionally, there resides an obstruction 508, such as an air duct, water pipe, electrical wires, etc. between adjacent overhead floor joists 416 and 417 (also shown between overhead floor joists 418 and 520). Horizontal blocking plate 402 is mounted between the bottom of floor joists 416 and 417 using fasteners 502. Additional support is provided by flat blocking supporter 507, secured with fasteners 506 and flat blocking holder 509, secured with fasteners 506. Flat pushing rod bracket 404 is fastened to the underside of horizontal blocking plate 402, aligned with the brace for the damaged wall 110. At least one vertical blocking 406 is attached between overhead floor joists 417 and 418, using fasteners 502. Additional vertical blocking 406 may be desired on subsequent floor joists as needed to distribute the bracing pressure. In one embodiment, there may be further obstructions 508 such as that show between overhead floor joists 418 and 520. In such cases, additional horizontal backing plate 519 may be fastened with fasteners 502.

Figure 6:
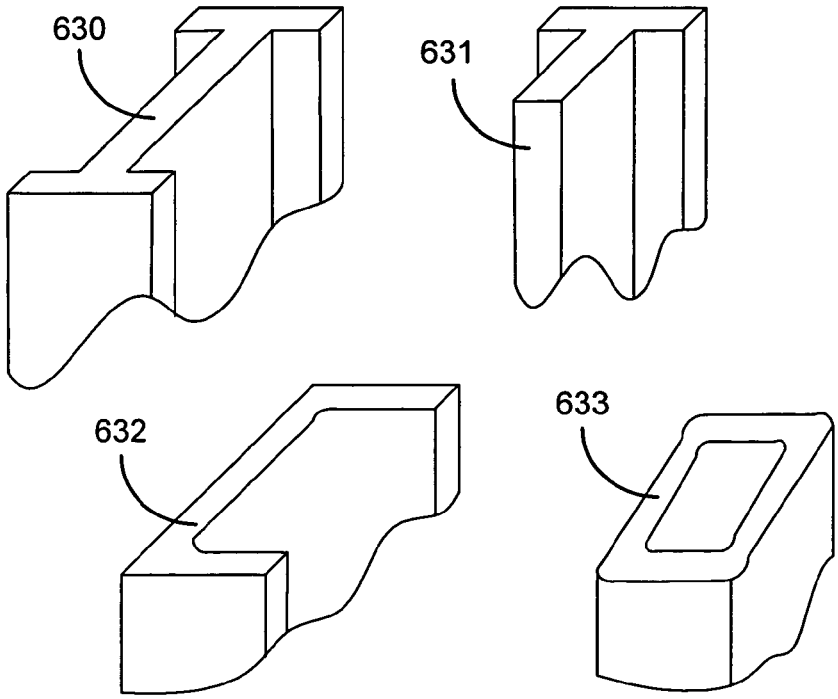
FIG. 6 is a perspective view of various styles of wall braces that may be utilized in conjunction with one preferred embodiment of the present invention.

One embodiment of the present invention includes a bracing system which utilizes various alignment braces as illustrated in FIG. 6. Commonly used in such applications is the I-beam 630, T-beam 631, C-channel 632 or Tube steel 633.

Figure 7:
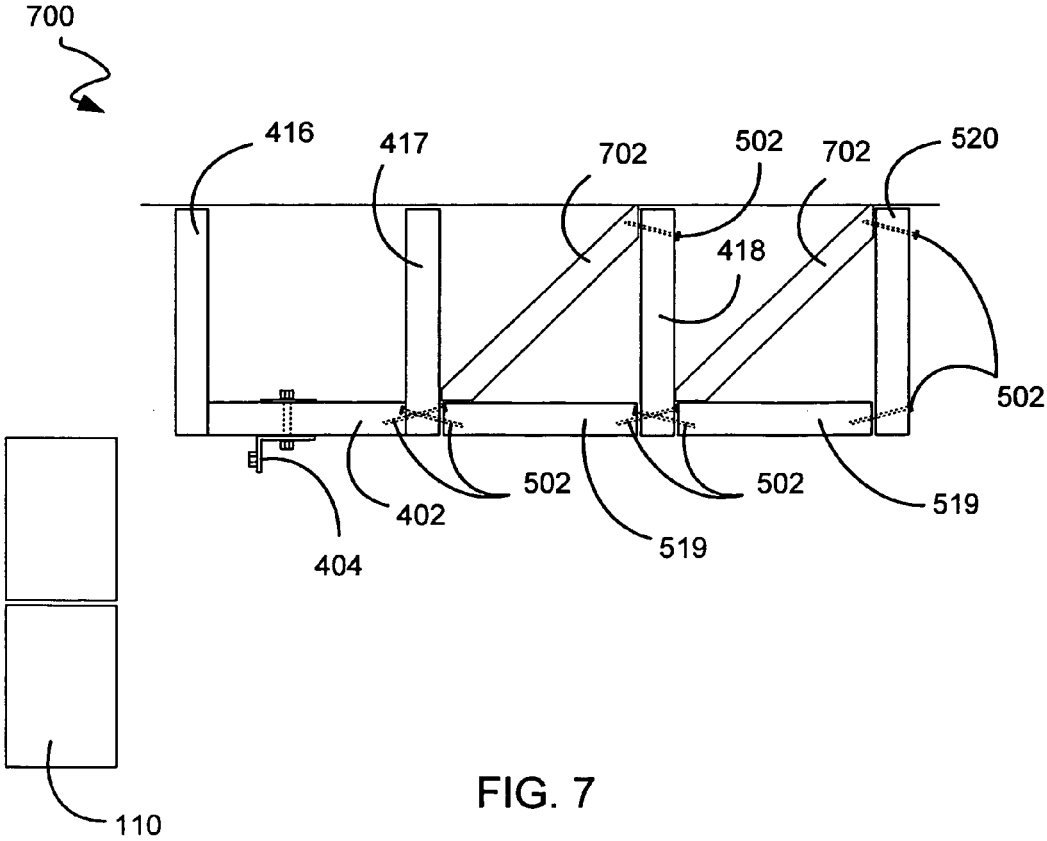
FIG. 7 is a side view of one preferred embodiment of the parallel configuration illustrated in FIG. 4 using diagonal bracing.

One embodiment of the present invention is illustrated in FIG. 7, which includes a bracing system 700 used to address mounting configurations different than that addressed by the bracing system of FIG. 5. The bracing system 700 includes a configuration similar to FIG. 5, however there are no obstructions 508. In this configuration, the operation is similar to a truss structure in which diagonal bracing 702 may be fastened between overhead floor joists 417, 418 and between overhead floor joists 418 and 520, fastened with fasteners 502. Further in this configuration, additional horizontal backing plates 519 may be fastened to overhead floor joists 418, 419, and 520 using fasteners 502. When using diagonal bracing 702, it is common to use two by four inch lumber instead of the vertical blocking 406, which is typically the same width as the floor joists, and provides sufficient support.

It is to be understood that even though numerous characteristics and advantages of various embodiments of the present invention have been set forth in the foregoing description, together with details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. For example all brackets and plates are preferably constructed of heavy gauge steel (greater than three sixteenths thickness) and fasteners consist of bolts, nuts, washers and nails, however other materials may be substituted provided strength and rigidity are not compromised. In some cases, pressure treated lumber may be used for floor joist material or damp conditions of floor and walls which would required galvanized or other treated fasteners to prevent or resist corrosion. Braces are preferably steel construction, however it is intended that other materials may be substituted without parting from the scope and spirit of the invention.

What is claimed is:

1. A wall bracing system for supporting a wall from an interior of a building basement, utilizing overhead floor joists, an alignment brace configured to reside below the overhead floor joists and having a first and second side, the first side of the brace adjacent with the wall, the brace further having an upper and a lower portion, the wall bracing system comprising:

a floor bracket operatively configured to be securely fastened to a floor and adjacent to the second side and the lower portion of the brace;

a pushing rod idler adjacent to the second side and the upper portion of the brace;

a pushing rod bracket operatively configured to be securely fastened to an overhead floor joist aligned with the pushing rod idler; and a jack mechanism extending from the pushing rod bracket to the pushing rod idler and operatively configured to apply force to the brace.

2. The wall bracing system of claim 1 further comprising:

at least one brace holder having a first and second end, the first end operatively configured to be securely fastened to one side of the pushing rod bracket, the second end operatively configured to be securely fastened to the wall.

3. The wall bracing system of claim 1, wherein the alignment brace is an I-beam.

4. The wall bracing system of claim 1, wherein the pushing rod idler includes a substantially round riser on a side opposite the alignment brace and further operatively configured to accept a magnetic insert.

5. The wall bracing system of claim 1, wherein the jack mechanism further comprises a pushing rod extending through a threaded flange on the bottom surface of the pushing rod bracket along an axis perpendicular to the wall surface and operatively configured to be inserted into the riser on the pushing rod idler, making contact with the magnetic insert of the pushing rod idler.

6. The wall bracing system of claim 1 further comprising a wall plate operatively configured to make contact with the first side of the alignment brace and the wall.

7. The wall bracing system of claim 1, wherein the pushing rod bracket is a flat pushing rod bracket operatively configured to be fastened to horizontal blocking in overhead floor joists.

8. The wall bracing system of claim 7, wherein the overhead floor joists are running parallel to the surface of the wall.

9. The wall bracing system of claim 8 further comprising vertical blocking on at least one overhead floor joist aligned with the pushing rod idler.

10. The wall bracing system of claim 1, wherein the jack mechanism, pushing rod bracket and alignment brace reside under and aligned with an overhead floor joist.

11. The wall bracing system of claim 1 further comprising at least one tube bracket holder operatively configured to be securely fastened between the pushing rod bracket and another overhead floor joist wherein the floor joists are substantially non-parallel relative to the wall surface.

12. A method of supporting a wall from an interior of a building basement, utilizing overhead floor joists, an alignment brace configured to reside below at least one overhead floor joist and having a first and second side, the first side of the brace is adjacent to the wall, the brace further having an upper and a lower portion, the method of supporting steps of:

securing a floor bracket to a floor;

securing a pushing rod bracket to one of the overhead floor joists, aligned with the floor bracket;

attaching a pushing rod idler to the upper portion and the second side of the alignment brace;

placing the alignment brace with the lower portion adjacent with the floor bracket and the upper portion aligned with the pushing rod bracket; and extending a jack mechanism between the pushing rod bracket and the pushing rod idler.

13. The method of supporting a wall of claim 12 further comprising the step of adjusting the jack mechanism to apply force to the brace and move the wall.

14. The method of supporting a wall of claim 12 further comprising the step of securing at least one brace holder between the pushing rod bracket and the wall.

15. A method of supporting a wall comprising the steps of claim 12 and further comprising a step of applying sufficient force to move the wall.

16. The method of supporting a wall of claim 12 further comprising a step of extending a threaded rod through a threaded flange on the pushing rod bracket along an axis perpendicular to the wall surface and seating the threaded rod against a magnetic insert residing within a substantially round riser on the alignment brace.

17. The method of supporting a wall of claim 12 further comprises a step of placing a wall plate between the alignment brace and the wall.

18. The method of supporting a wall of claim 12 further wherein the step of securing the pushing rod bracket comprises utilizing a flat pushing rod bracket and securing to horizontal blocking residing between overhead floor joists.

19. The method of supporting a wall of claim 12 further comprising the step of securing at least one tube bracket holder between the pushing rod bracket and another overhead floor joist wherein the floor joists are substantially non-parallel relative to the wall surface.

20. A wall bracing system for supporting an interior of a basement wall comprising:

a floor bracket secured to a floor adjacent to the wall;

an alignment brace residing below at least one overhead floor joist and having a first and second side, the first side of the brace is adjacent to the wall, the brace further having an upper and a lower portion, the lower portion between the floor bracket and the wall;

a pushing rod idler having a substantially round riser, the riser further having a magnetic insert, the pushing rod idler further residing on the second side and upper portion of the alignment brace;

a flat pushing rod bracket having a threaded flange, the stationary bracket further aligned with the pushing rod idler and secured to one of the following:

an overhead floor joist;

a horizontal block residing between overhead floor joists; and a horizontal block residing between overhead floor joists wherein the floor joists are substantially non-parallel relative to the wall surface; and a jack mechanism extending from the flat pushing rod bracket to the pushing rod idler and configured to apply force to straighten the wall, the jack mechanism further comprising a threaded rod adjustably positioned through the threaded flange on the flat pushing rod bracket and seated against the magnetic insert residing within the riser of the pushing rod idler.

21. The wall bracing system of claim 20, wherein overhead floor joists are substantially non-parallel relative to the wall surface, the wall bracing system further comprising:

at least one tube bracket holder secured between the flat pushing rod bracket and an overhead floor joist adjacent to that which is secured to the flat pushing rod bracket; and at least one brace holder secured between the flat pushing rod bracket and the wall.

22. The wall bracing system of claim 20, wherein overhead floor joists are substantially parallel relative to the wall surface, the wall bracing system further comprising vertical blocking on at least one overhead floor joist aligned with the pushing rod idler.

23. The wall bracing system of claim 20, wherein overhead floor joists are substantially non-parallel relative to the wall surface, the wall bracing system further comprising a backer support plate operatively configured to be securely fastened to at least one side of the flat pushing rod bracket.

24. The wall bracing system of claim 20 further comprising a wall plate between the alignment brace and the wall.

* * * * *